United States Patent [19]

Unger

[11] Patent Number: 5,076,478

[45] Date of Patent: Dec. 31, 1991

[54] WATER HOLDING DEVICE FOR USE BY WINDOW WASHERS

[75] Inventor: Henry M. Unger, Weston, Conn.

[73] Assignee: Unger Licensing Inc., Brideport, Del.

[21] Appl. No.: 626,253

[22] Filed: Dec. 11, 1990

[51] Int. Cl.[5] ..... A45F 5/00

[52] U.S. Cl. ..... 224/148; 224/183; 224/251; 224/253; 224/904; 220/505; 220/555

[58] Field of Search ..... 224/148, 253, 904, 251, 224/183; 220/555, 505; 206/209, 209.1

[56] References Cited

U.S. PATENT DOCUMENTS 1,508,724 9/1924 Rose ..... 224/148
2,784,434 3/1957 Little ..... 220/555

FOREIGN PATENT DOCUMENTS 782971 7/1935 France ..... 220/505

*Primary Examiner*—Linda J. Sholl
*Attorney, Agent, or Firm*—Abelman Frayne & Schwab

[57] ABSTRACT

A water holding device for a window washer as a first water tank for the reception of a window washing tool, and has a second water tank in communication with the first water tank at its lower end for the relief of pressure caused in the first water tank by rapid insertion of a working tool into the first water tank, the water holding device being of progressively decreasing cross-section in a downwards direction in order to minimize the volume of water required in the first water tank, and thus minimize the weight to be carried by the user.

7 Claims, 2 Drawing Sheets

WATER HOLDING DEVICE FOR USE BY WINDOW WASHERS

FIELD OF THE INVENTION

This invention relates to a device for use by a person employed to wash windows, particularly large windows of commercial establishments such as store or restaurant fronts, or, the windows of office buildings.

The object of this invention is to provide that person with a readily portable supply of water for use in wetting a window washing applicator, and, for use in washing debris from a squeegee blade, the device additionally providing storage for either one of the window washing applicator or the squeegee as the person is utilizing the other of those tools, or, which can provide portable storage for both of those tools as the person moves from one location to another.

BACKGROUND OF THE ART

It has been prior proposed to provide a water container of hollow tubular form and of uniform square cross-section that can be hung from the belt of a person washing windows. That container is of uniform square cross-section throughout its height, and is provided on one side with a slot permitting the shank of a window washing applicator or that of a squeegee blade to pass downwardly into the container in order to immerse one half of the applicator or squeegee blade in the contained body of water. Commonly, the applicator or washing blade extends transversely to opposite sides of the shank in T-formation with a handle attached to the shank and that is to be hand-held by the user.

That construction, however, limits the user to the use of either the applicator or the squeegee blade at any one time, and requires the other of the tools to be carried in separate storage during the use of that specific tool. This constitutes a source of inconvenience to the user, and also increases the time required to complete a window washing operation.

Additionally, the use of a tubular form of water container of uniform square cross-section is encumbered with the disadvantage that when an applicator is inserted into the contained water it acts as a piston, and as the applicator progresses downwardly the water in the container is forcibly displaced upwardly. Not only is this a source of inconvenience to the user in that the water is caused to squirt out onto the persons clothing, but also, it requires that a relatively large volume and weight of water be stored in the device for its successful operation when in use.

OBJECT OF THE INVENTION

It is the object of this invention to provide a water holding device for use by a window washer that has all of the advantages of the known water holding device, and which additionally eliminates or mitigates the possibility of squirting or splashing of the contained water onto the user's clothing, while at the same time permitting a relatively small volume of contained water to be successfully employed in the washing operation, to the added comfort of the user who is thus required to carry less weight of water.

SUMMARY OF THE INVENTION

According to the present invention, the water holding device for use by a person washing windows is comprised of two separate water holding compartments that are interconnected one with the other in a manner permitting water to flow from one compartment to the other, one of the compartments providing for the wetting of a applicator and the other providing for the carrying and wetting of a squeegee blade, the respective compartments providing for storage of one of those tools while the other is in use, and, providing for the storage of both of those tools as the user moves from place to place.

The water container is formed of progressively increasing transverse cross-section from its bottom most end to the uppermost end thereof, and the intercommunication between the two compartments is arranged in a proximity with the bottom ends thereof. Thus, at the time an applicator is forcibly inserted into its container, the water in that container, instead of squirting upwardly around the sides of the applicator, can transfer to the other of the containers, which preferably also is of progressively increasing transverse cross-section from its lowermost end to the uppermost end thereof.

In this manner, the other of the containers intended to hold the squeegee blade it employed as a buffer against sudden increases in pressure in the container for the applicator, the container for the squeegee blade thus acting to dampen pressure increases within the container for the applicator in the manner of a manometer, thus eliminating the tendency of upward squirting of the water within the container for the applicator.

Preferably, the container for the squeegee blade is so configured that it can receive the squeegee blade in either of two positions, thus allowing for insertion of the squeegee blade into the container by either the user's right hand, or, reversely by the user's left hand when passed around the user's body.

DESCRIPTION OF THE DRAWINGS

A preferred embodiment of the present invention will now be described with reference the accompanying drawings, in which.

DESCRIPTION OF THE PREFERRED EMBODIMENT

Figure 1:
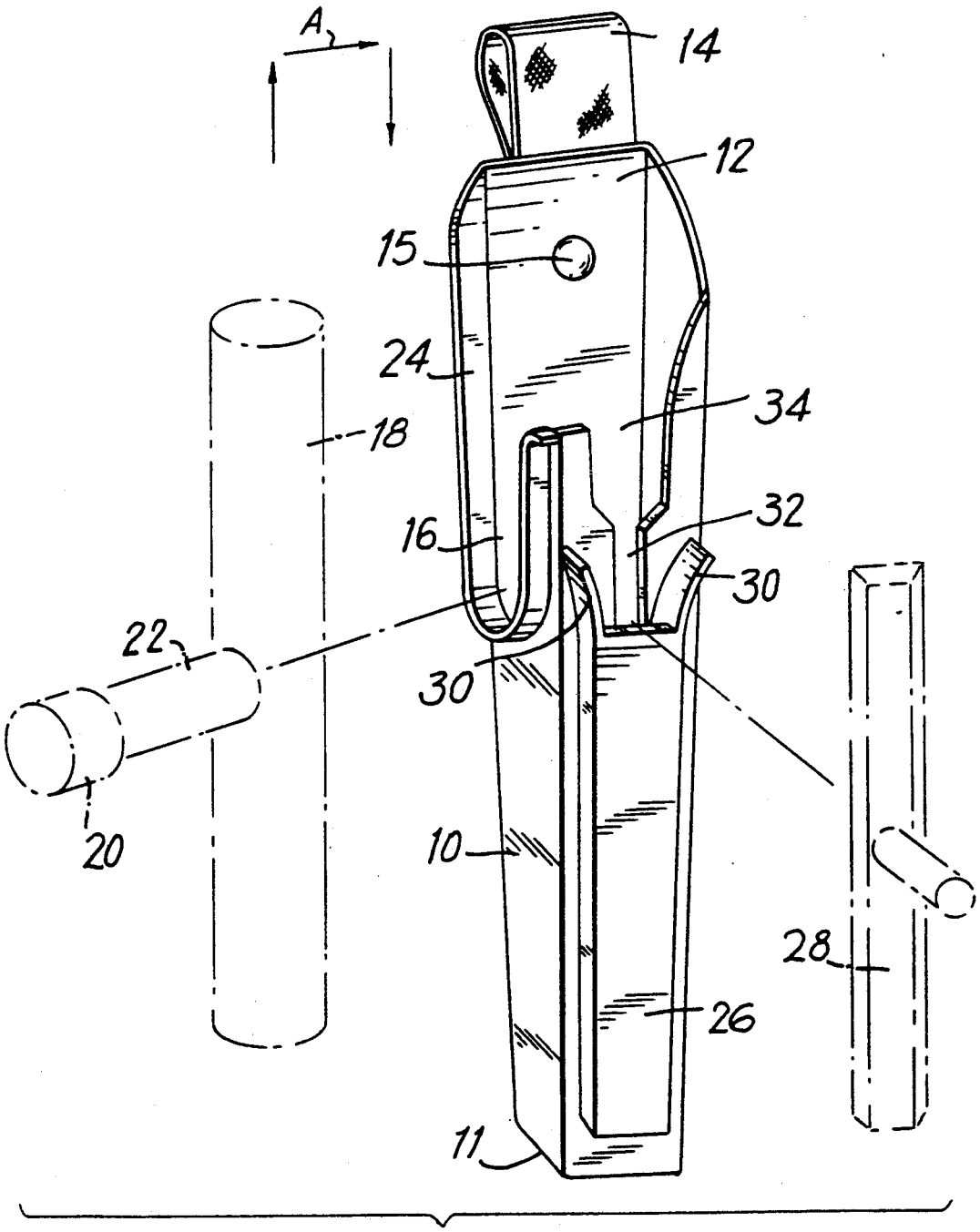
FIG. 1 is a front perspective view of the water holding device of the invention.
Figure 2:
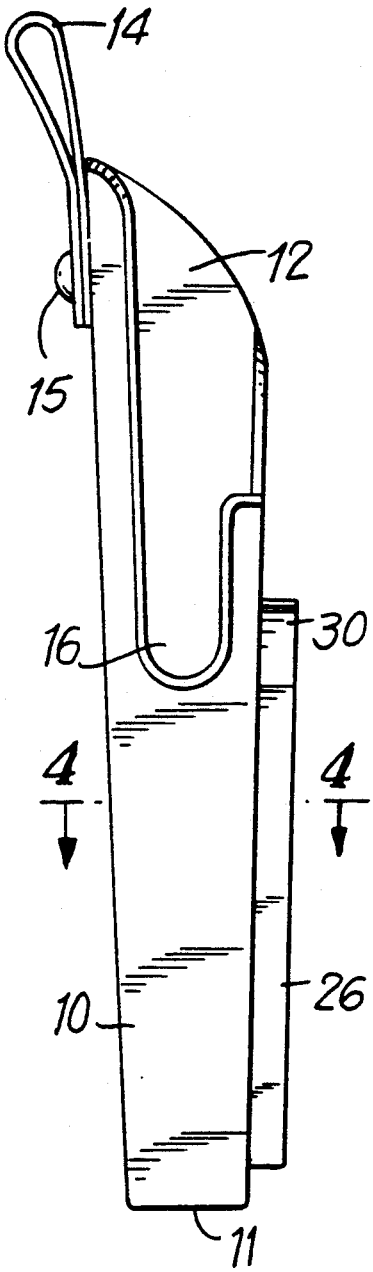
FIG. 2 is a left-hand side elevation of FIG. 1.
Figure 3:
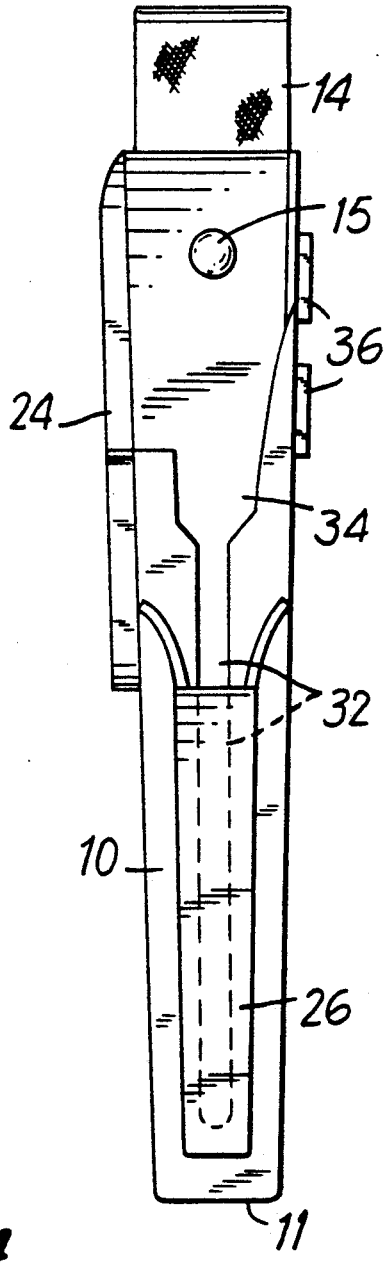
FIG. 3 is a front elevation of FIG. 1.
Figure 4:
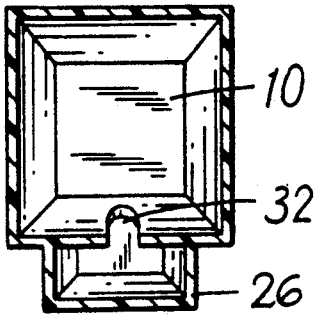
FIG. 4 is a transverse cross-section taken on the line 4,4 of FIG. 2.

The drawings illustrate a water holding device in the form of a vertically elongate water tank 10 having a closed bottom end 11 and an open top end 12. The tank 10 is intended to be hung from the belt of a user by means of a belt loop 14 that is secured to a rear face of the tank 10 by a rivet 15.

The tank is to be worn at the right hand side of the user's body in the manner of a pistol holder, with a side opening 16 at the upper end of the tank facing rearwardly of the user. Then, with the user's right hand the user can insert or withdraw one end of a T-shaped window washing applicator, indicated generally at 18, in the form of a rod or bar of applicator material carried by a hand holdable handle 20 through the intermediary of a shank 22.

As will be apparent, one end of the window washing applicator 18 can be inserted into the tank 10 by moving the window washer 18–22 in the directions of the arrows A, in order for the lower end of the window washing element 18 to be submerged within the body of water within the tank 10. Conveniently, rails 24 are provided surrounding the opening 16, in order to guide the window washer and its shank 22 during insertion and removal of the window washer.

On the front face of the tank 10 is mounted a secondary tank 26, the tank 26 being adapted to receive one end of a squeegee blade, indicated diagrammatically at 28. Insertion and removal of the squeegee blade follows the same general paths as the arrows A, but in the reverse directions. Conveniently, guides 30 are provided at the upper end of the secondary tank 24 to assist in the guiding and removal of the squeegee blade relative to the secondary tank 26.

The secondary tank 26 communicates with the tank 10 throughout the length of the secondary tank 26 by means of a slot 32 extending through the front wall of the tank 10. The slot 32 is of lesser width than the width of the squeegee blade, thus ensuring that the window washing applicator does not frictionally engage the squeegee blade during movements of the applicator within the tank 10. Conveniently, a larger slot 34 is provided at the upper end of the slot 32, this allowing the window washer 18 either to be inserted into the opening 16, or, for it to be "parked" in the opening 34, thus giving the user the option of having the handle of the window washer extending rearwardly of the user's body, or, extending laterally of the user's body.

As will be observed from the drawings, the tank 10 is of progressively decreasing cross-section in a downwards direction. This downward taper and the interconnection through the slot 32 between the main water chamber 10 and the secondary water chamber 26 is provided in order to minimize the effects of sudden downward emersion of one end of the window washer 18 in a quick movement of the user's hand. In the event that the user moves the window washer 18 downwardly in a quick movement, instead of water being squirted up the sides of the window washer 18 and onto the user's clothing, water displaced in from the tank 10 upon downward movement of the window washer 18 dominantly moves laterally into the secondary tank 26, in which the water column can rise as in the manner of a manometer, thus reducing or negating the tendency of the water contained in the tank 10 to squirt upwardly around the sides of the window washer 18 during a quick downward movement of the window washer 18. Thus, not only is the probability of wetting the user's clothing reduced or eliminated, but also, a strongly convected current of water is provided for washing the squeegee blade 28, which will be "parked" in the secondary tank 26 during use of the window washer 18.

The window washer 18 can then be returned or "parked" in the primary water tank 10, and, the squeegee blade 28 then be withdrawn from the secondary tank 26 for use in succession to the window washer.

Upon completion of the window washing operation, both the window washer 18 and the squeegee blade 28 then can be "parked" in their respective tanks 10 and 26, thus freeing the user's hands and affording ready portability of the window washer 18 and squeegee blade 28 without inconvenience to the user.

Conveniently, the entire assembly with the exception of the belt loop 14 can be molded as a single one-shot pressure molding from an ABS resin, vinyl or other suitable plastics material. The belt loop 14 can then be attached to the main body by any convenient technique, such as by riveting, ultrasonic welding and the like.

If desired, magnets 36 can be provided on the side of the main water tank 10, the magnets being employed to hold and secure a scraper or blades formed from a ferromagnetic material.

I claim:

1. A water holding device for use by a window washer, which includes an elongate vertically arranged primary water tank adapted to be hung on a user's belt, and which has an opening in the side thereof extending downwardly from an upper edge of the tank for accommodating a shank of a window washing tool, further including:

a secondary water tank mounted on a frontal surface of said primary water tank, and communicating with a lowermost end of said primary water tank through an opening, said secondary water tank having an opening at an blade;

whereby, water placed under pressure by a working tool descending within said primary water tank is diverted into said secondary water tank and is free to move upwardly within said secondary water tank and thus minimize the effects of water squirting upwardly past said working tool.

2. The water holding device of claim 1, in which said primary water tank is of progressively decreasing cross-sectional area in a downwards direction in order to minimize the volume of contained water and the weight thereof required for proper wetting of said working tool.

3. The water holding device of claim 1, including a vertically extending open slot providing said opening communicating said primary water tank and said secondary water tank.

4. The water holding device of claim 1, including guide rails positioned at said open upper end of said secondary water tank for guiding a working tool into said secondary water tank.

5. The water holding device of claim 4, further including guide rails positioned at said upper side opening of said primary water tank for guiding a working tool into said primary water tank.

6. The water holding device of claim 1, further including magnetic fastener means secured to said primary water tank for holding a ferromagnetic working tool.

7. The water holding device of claim 3, further including a second vertically extending open slot surmounting said first vertically extending open slot and of greater width than said first vertically extending open slot for the alternative reception of said shank of said window washing tool.

* * * * *